US005941713A

United States Patent [19]

Wayner et al.

[11] Patent Number: 5,941,713

[45] Date of Patent: Aug. 24, 1999

[54] MOBILE DISPLAY BOARD ARRANGEMENT

[75] Inventors: Robert C. Wayner, Holland; Clarkson S. Thorp, Wayland; Bryan R. Gingrich, Holland, all of Mich.

[73] Assignee: Haworth, Inc., Holland, Mich.

[21] Appl. No.: 08/870,129

[22] Filed: Jun. 6, 1997

[51] Int. Cl.[6] ..... B43L 1/00; A47B 19/00

[52] U.S. Cl. ..... 434/414; 434/408; 434/418; 434/429; 248/441.1

[58] Field of Search ..... 434/408, 414, 434/413, 415, 418, 417, 429, 192; 248/441.1, 206.5; 312/231; 403/DIG. 1; 281/DIG. 1

[56] References Cited

U.S. PATENT DOCUMENTS

| | | | |
|---|---|---|---|
| D. 46,745 | 12/1914 | Kyle | D19/52 |
| D. 252,758 | 8/1979 | Prall | D19/62 |
| D. 302,986 | 8/1989 | Takai et al. | D18/36 |
| D. 303,187 | 9/1989 | Mickelsen | D6/443 |
| D. 380,232 | 6/1997 | Egan et al. | D20/10 |
| 589,180 | 8/1897 | Lamb | 434/430 |
| 2,485,517 | 10/1949 | Vaule et al. | 248/464 |
| 2,671,566 | 3/1954 | Levy, Jr. | 211/45 |
| 2,808,308 | 10/1957 | Papelian et al. | 312/231 |
| 2,833,550 | 5/1958 | Frick | 280/47.34 |
| 2,981,030 | 4/1961 | Knop | 211/74 |
| 3,107,442 | 10/1963 | Levine | 434/417 |
| 3,468,039 | 9/1969 | Dubbert | 434/429 |
| 4,098,009 | 7/1978 | Flynn | 434/88 |
| 4,123,127 | 10/1978 | Ford | 312/230 |
| 4,457,717 | 7/1984 | Chika | 434/88 |
| 4,667,254 | 5/1987 | Araki et al. | 358/451 |
| 5,104,085 | 4/1992 | Brice | 248/441.1 |
| 5,200,853 | 4/1993 | Berkman | 359/443 |
| 5,273,248 | 12/1993 | Grander | 248/460 |
| 5,397,091 | 3/1995 | Tsuar | 248/441.1 |
| 5,492,476 | 2/1996 | Ball et al. | 434/408 |
| 5,511,348 | 4/1996 | Cornell et al. | 52/239 |
| 5,725,380 | 3/1998 | Kennelly | 434/203 |

FOREIGN PATENT DOCUMENTS

| | | | |
|---|---|---|---|
| 165217 | 7/1949 | Germany | 434/408 |

OTHER PUBLICATIONS

Magnetic Visual Control Systems catalog, p. 47, Apr. 6, 1982.

*Primary Examiner*—Robert A. Hafer
*Assistant Examiner*—Michael Priddy
*Attorney, Agent, or Firm*—Flynn, Thiel, Boutell & Tanis, P.C.

[57] ABSTRACT

A mobile marker board unit has a wheeled base which mounts a pair of upright and vertically enlarged marker boards. The marker boards, as they project upwardly, are rearwardly sloped to define a triangular storage space between the marker boards. This storage space is accessible from at least one end of the unit, and is preferably provided with structure which permits storage therein. A slidable tray arrangement is mounted adjacent the lower edge of each marker board and can be moved between open and closed positions. Each tray arrangement includes an outer tray disposed directly adjacent the lower edge of the marker board and positioned for support of articles thereon. This outer tray is fixedly joined to an enlarged inner tray which is normally stored in a closed position between the marker boards, with the tray assembly being slidable into an outer position wherein the inner tray projects outwardly from the marker board adjacent the lower edge thereof.

23 Claims, 16 Drawing Sheets

MOBILE DISPLAY BOARD ARRANGEMENT

FIELD OF THE INVENTION

This invention relates to a display board arrangement and, more particularly, to an improved mobile marker board arrangement providing increased capabilities with respect to use of same with other types of visual displays, as well as increased support and storage capability, to permit increased convenience and flexibility of use.

BACKGROUND OF THE INVENTION

Marker board arrangements are extensively utilized in office and teaching environments, not only by individuals who find it convenient to work on such devices, but more particularly in group situations where such marker board provides an extremely convenient tool for visual presentation of information. Such marker board arrangements traditionally employ a vertically enlarged marker board having an enlarged smooth white surface, defined by a conventional plastic resin or the like, to permit use with conventional erasable colored marker pens.

The conventional marker board arrangements assume many different constructural shapes and configurations. Many such arrangements are portable, and often comprise a marker board associated with a foldable or collapsible frame to enable the arrangement to be moved about as desired. Arrangements of this type, however, generally consist primarily only of a marker board, and thus this not only limits flexibility of use in terms of the different types of visual information which can be displayed thereon, but also the assembly and transport of such arrangements is often complex and inconvenient.

To improve on the portability and flexibility of use, mobile marker boards have been provided which incorporate a support base having wheels for rolling engagement with the floor, and with the marker board permanently mounted on and projecting upwardly from the base. In one known marker board arrangement of this type, the base has a generally vertically enlarged marker board provided on one side thereof, and a vertically enlarged tack board provided on the other side thereof. While such arrangement increases the display capabilities and the flexibility of transport, nevertheless even this type of arrangement possesses disadvantages in that one cannot readily adapt it for display with different media since the tack board and marker board are disposed on opposite sides, and both cannot be substantially simultaneously and conveniently utilized, particularly when the arrangement is being used for dissemination of information to a group of people. Further, such arrangement, as is common with arrangements of this type, does not provide adequate support or storage for visual display articles such as papers and drawings, particularly when the marker board arrangement is being utilized for dissemination of information to a group of people.

It is an object of this invention to provide a display board arrangement and more particularly a mobile marker board arrangement which significantly improves the ability to provide for support and display of information, particularly information which may assume many different display forms or media, whereby the marker board arrangement provides increased flexibility of use in addition to convenient use of colored marker pens, and which at the same time provides desirable mobility for transport and storage, and hence overcomes many of the disadvantages associated with prior marker board constructions.

More specifically, the improved mobile marker board unit of this invention, in a preferred embodiment thereof, incorporates a support base mounted on casters or wheels to provide mobility. The base is preferably defined as an upright open shelf or storage unit having spaced upper and lower support shelves to define a storage space therebetween which is preferably accessible from both sides of the base and permits storage on the lower shelf. This base mounts a pair of generally upright and vertically enlarged marker boards which define marker board surfaces which face outwardly in opposite directions. The marker boards, as they project upwardly, are each slightly rearwardly sloped to define a convenient angle for display and use of the marker board surface. The two marker boards define therebetween a generally triangular storage space which projects upwardly from the upper shelf of the base. This storage space is preferably accessible from either end of the marker board arrangement, and is provided with structure which permits different types of storage within the interior space. In one variation the interior storage may be defined by a plurality of upright rods which divide the interior storage into a plurality of adjacent subcompartments to permit storage of sheetlike objects, or similar shaped articles, therein. In an alternate variation the lower portion of the interior storage space can be provided with one or more drawers which are mounted above the top shelf of the base, and are slidable outwardly through one or both ends of the interior storage space to provide access thereto. The interior storage space can be vertically divided by an interior shelf, if desired, and the upper region of the storage space can be utilized for storage of different types of objects, such as rolled drawings and the like.

The improved mobile marker board arrangement of the invention, as aforesaid, also preferably incorporates slidable tray arrangements which permit support thereon of objects such as papers or the like, and which are disposed adjacent the lower edge of each marker board and can be moved between open and closed positions. Each such tray arrangement includes an outer elongate tray which, when the tray assembly is in a closed position, is disposed directly adjacent the lower edge of the marker board and is positioned for support of conventional articles such as marker pens and erasers thereon. This outer tray in turn is fixedly joined to an enlarged inner tray which is normally stored in a closed position wherein it is disposed between the marker boards directly above the upper shelf of the base, with this tray being slidable into an outer position wherein the inner tray then projects outwardly from the marker board adjacent the lower edge thereof. This inner tray provides an enlarged support surface directly adjacent the lower edge of the marker board to facilitate use of the overall arrangement by an individual.

The improved marker board arrangement of this invention, as aforesaid, also preferably incorporates a structure which enables removable magnetic support members to be used in conjunction therewith. For this purpose the marker board preferably has the outer marker layer thereof disposed in overlying relationship to an underlying metal layer, such as sheet metal. The magnetic support members are preferably formed as individual thin platelike members, such as elongate platelike strips, formed of a conventional magnetic plastic material. These magnetic support plates, on a front face thereof, are provided with an adhering-type coating thereon. The magnetic support plates can be stored in the interior storage area and, when use of same is desired, they can be magnetically engaged with the front face of the marker board. These magnetic support plates permit sheets, such as drawings or the like, to be attached to the front face thereof, and permit easy interchange of such sheets to facilitate use of the marker board surface for display and interchange of display sheets and the like. At the same time, other regions of the marker board can still be utilized for use with ink marker pens. With the interior storage stray extended into its open position, this tray provides a convenient support shelf for positioning thereon of various sheets or papers, which papers are conveniently accessible to an individual for attachment to the magnetic support plates which are detachably positioned on the marker board surface.

The improved marker board arrangement of the invention, as aforesaid, also preferably mounts a hanger structure associated with and extending longitudinally along the upper edge thereof, which hanger structure permits various hanger units to be detachably engaged therewith. Such hanger units may comprise auxiliary shelf units or a roll-up screen. Such hanger units are mountable adjacent the upper edge of the marker board surface to provide temporary storage for papers or other visual display objects, or in the case of a roll-up screen for permitting the screen to be opened downwardly in front of the marker board for use with a photoprojector or any other type of visual display screen.

As is believed apparent from the arrangement as summarized above, the improved marker board arrangement provides increased and desirable flexibility of use so that multiple display media and information can be used in conjunction therewith, as well as retaining the desirable capability of using conventional ink marker pens, and the mobility of the unit facilitates ease of transport and storage thereof.

Other objects and purposes of the invention will be apparent to persons familiar with arrangements of this general type upon reading the following specification and inspecting the accompanying drawings.

Figure 1:
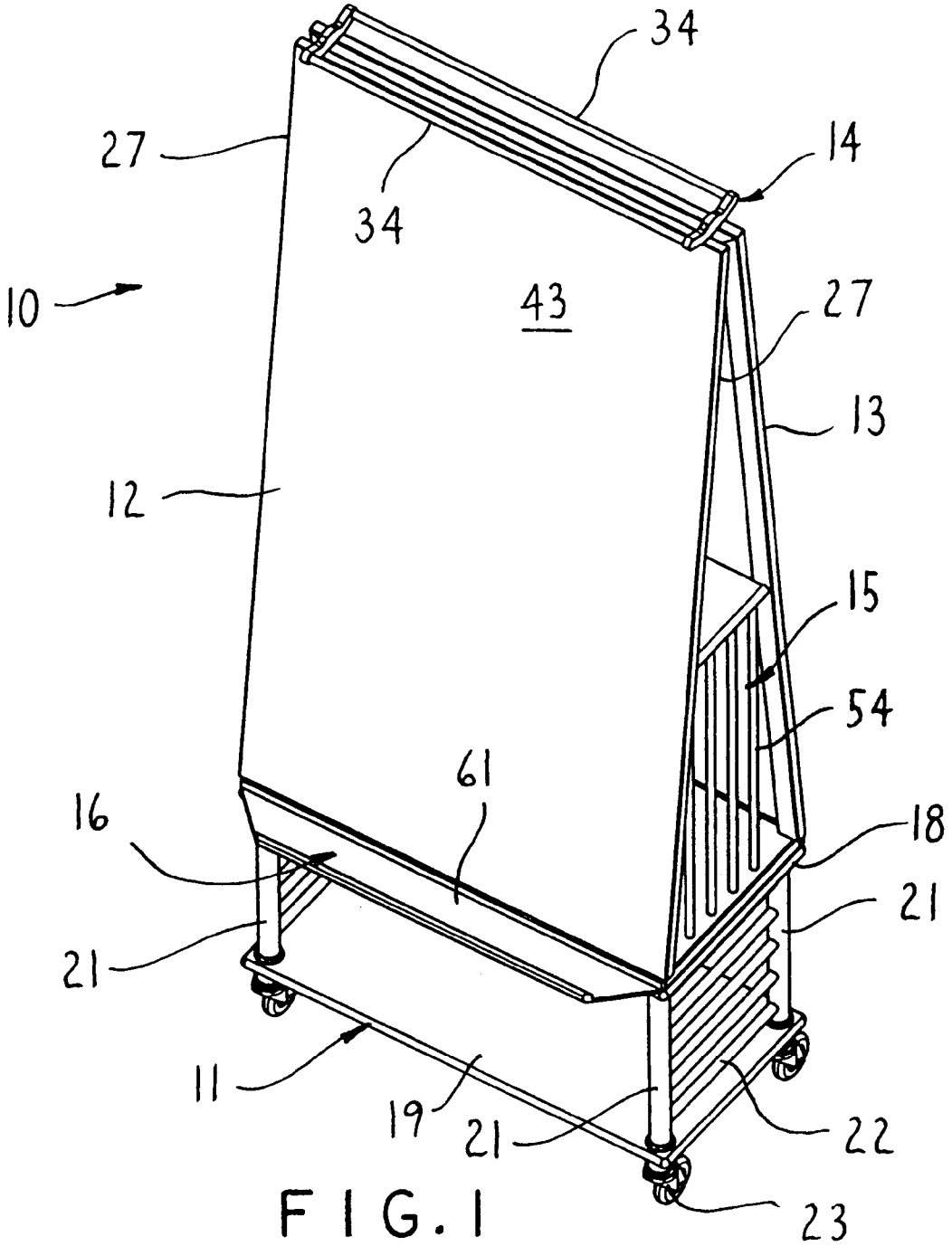
FIG. 1 is a perspective view of the improved mobile marker board arrangement according to the present invention.

Certain terminology will be used in the following description for convenience in reference only, and will not be limiting. For example, the words "upwardly", "downwardly", "rightwardly" and "leftwardly" will refer to directions in the drawings to which reference is made. The words "upper" and "lower" will also be used in reference to the actual position of the marker board arrangement when in use, such as the upper and lower edges thereof when the marker board is seen by an individual. The words "inwardly" and "outwardly" will refer to directions toward and away from, respectively, the geometric center of the arrangement and designated parts thereof. The word "front" will refer to the side of the marker board arrangement which is exteriorly visible and usable. Said terminology will include the words specifically mentioned, derivatives thereof, and words of similar import.

DETAILED DESCRIPTION

Referring to the drawings and specifically FIGS. 1–5, there is illustrated a mobile marker board arrangement 10 according to the present invention, which arrangement 10 will herein be referred to as a mobile display assembly inasmuch as it provides for numerous display or use functions in addition to conventional marker board functions, as explained hereinafter.

The display assembly 10 includes a base assembly 11 which stationarily supports thereon a pair of generally vertically enlarged display boards 12 and 13, the latter projecting upwardly from the base assembly in generally back-to-back relationship so that they face outwardly toward opposite sides of the overall arrangement. The boards 12 and 13 are fixedly joined adjacent their upper edges by a bracket arrangement 14. The boards 12 and 13 also define therebetween an article storage structure 15 which is preferably accessible from each end of the arrangement. A slidable tray arrangement 16 is also provided on each side of the display assembly 10 adjacent the lower edge of each board 12 and 13.

The base assembly 11 is preferably constructed similar to an upright shelf unit in that it includes generally horizontally enlarged platelike top and bottom support members 18 and 19 respectively, which are disposed in superimposed but vertically spaced relation. A plurality of vertical or upright posts 21 extend between and fixedly join the upper and lower support members 18 and 19 adjacent the four corners thereof. Each adjacent pair of end posts 21 are rigidly joined together, as by a plurality of vertically spaced and horizontally extending cross rods 22, to define an end wall structure. A roller or caster 23 is mounted to the underside of the bottom support member 19, preferably adjacent each corner thereof, to provide rolling support for the entire display assembly 10.

Figure 2:
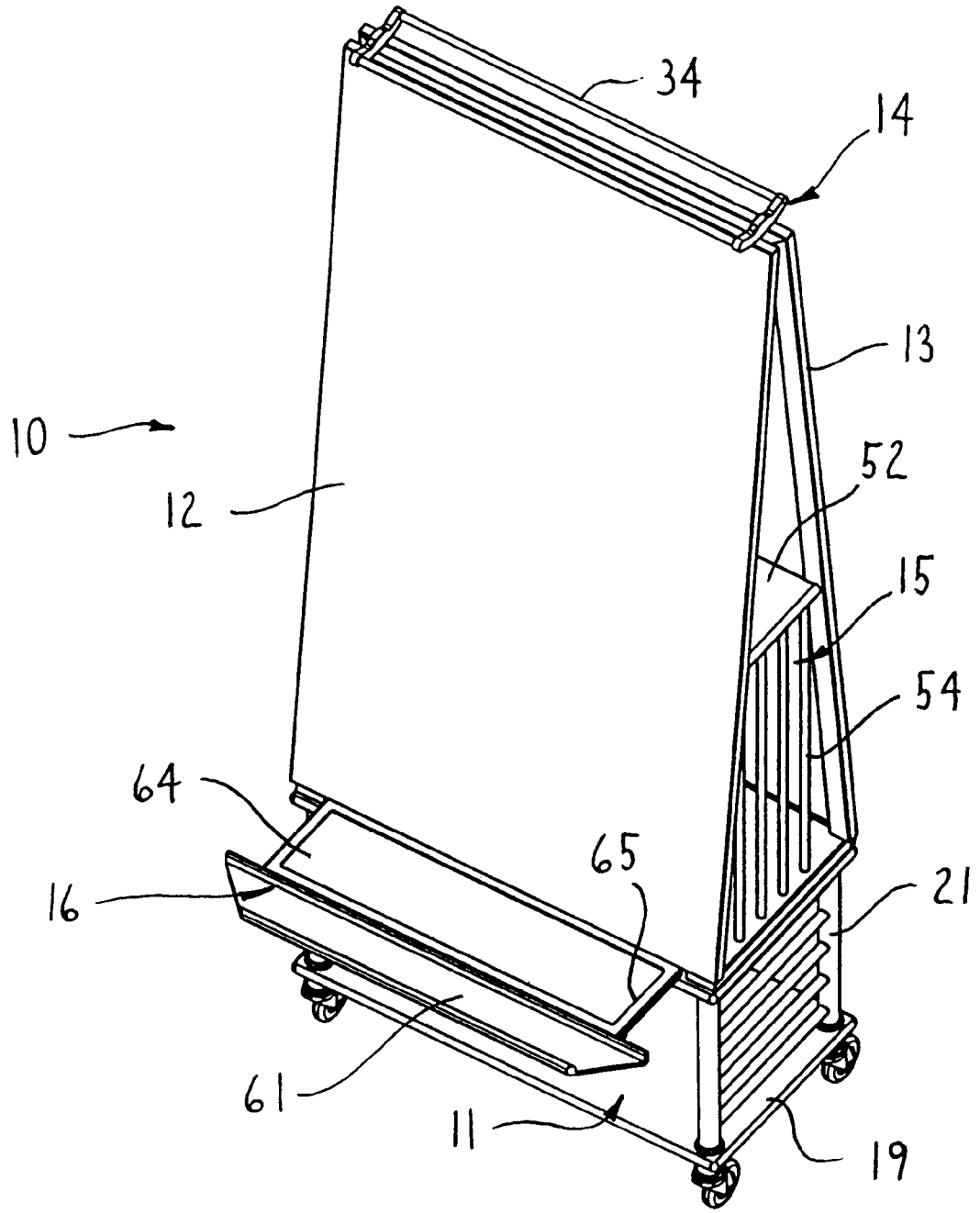
FIG. 2 is a perspective view similar to FIG. 1 but illustrating the tray arrangement associated with one side thereof in an open or extended position.
Figure 3:
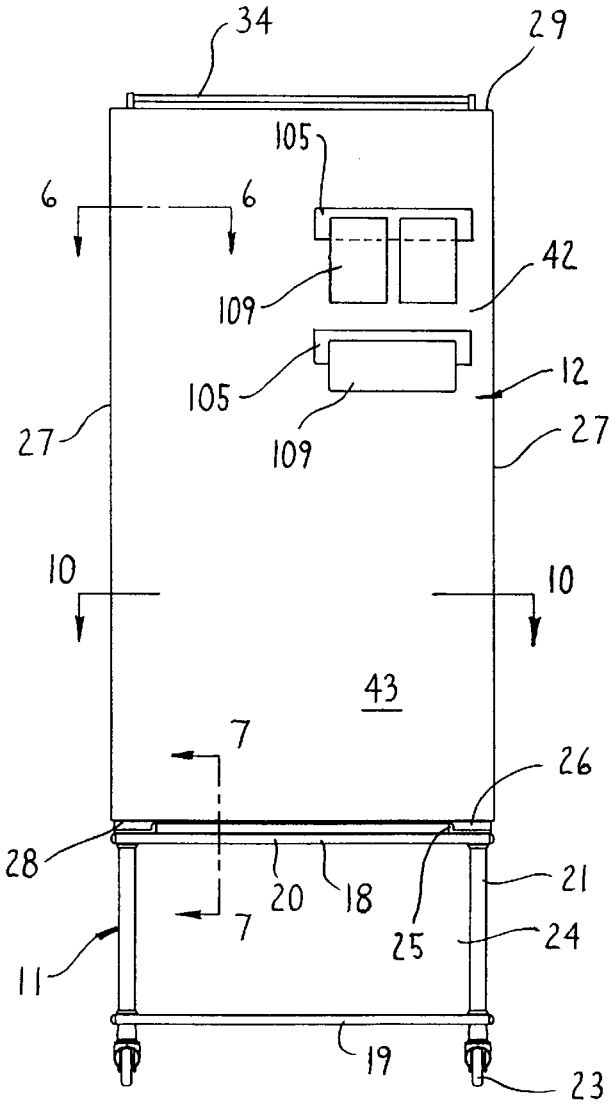
FIG. 3 is a front view of the marker board arrangement shown in FIG. 1.

As shown by FIGS. 1–3, the construction of base assembly 11 is such that a rather large storage space or region 24 is defined interiorly of the base between the upper and lower support members 18 and 19. This storage region 24 enables numerous objects such as display articles, projectors or the like, to be stored on the upper surface of the bottom shelf 19. This storage region 24 is preferably readily accessible from both sides of the display assembly 10, with both sides in the illustrated embodiment being open. It will be appreciated, however, that the sides of the base unit can be provided with openable doors if desired.

The top support 18 of the base assembly has a bottom shelf or plate 20 which is superimposed by and fixedly supports thereon a generally horizontally enlarged platelike drawer support 26, the latter being substantially coextensive with the upper surface of the top shelf 20. This drawer support 26 defines therein a recess or cutout 25 which opens upwardly from the bottom surface thereof. The cutout 25 is spaced inwardly from opposite ends of the drawer support 26 but extends transversely across the entire width of the drawer support so as to open outwardly at both sides of the display unit 10. This cutout 25 accommodates therein a pair of slidable tray structures 16 as described hereinafter.

Figure 4:
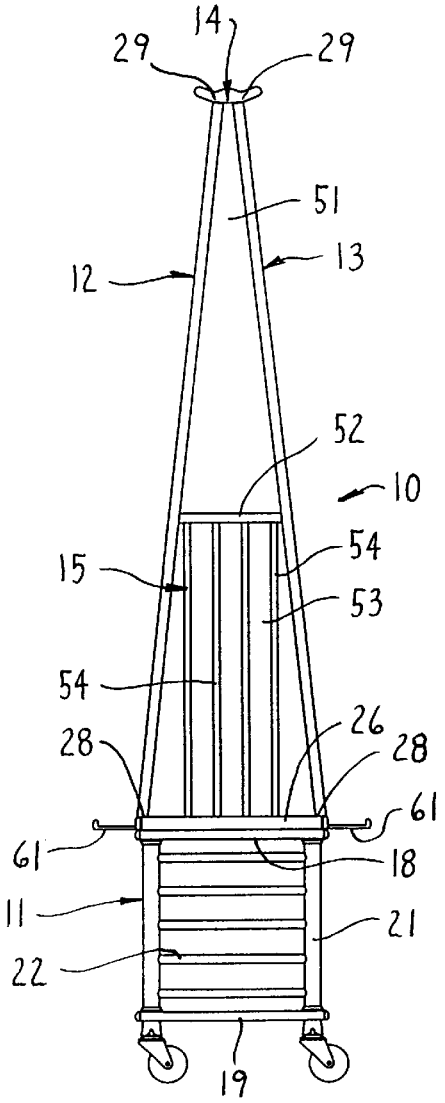
FIG. 4 is a right end elevational view thereof.
Figure 5:
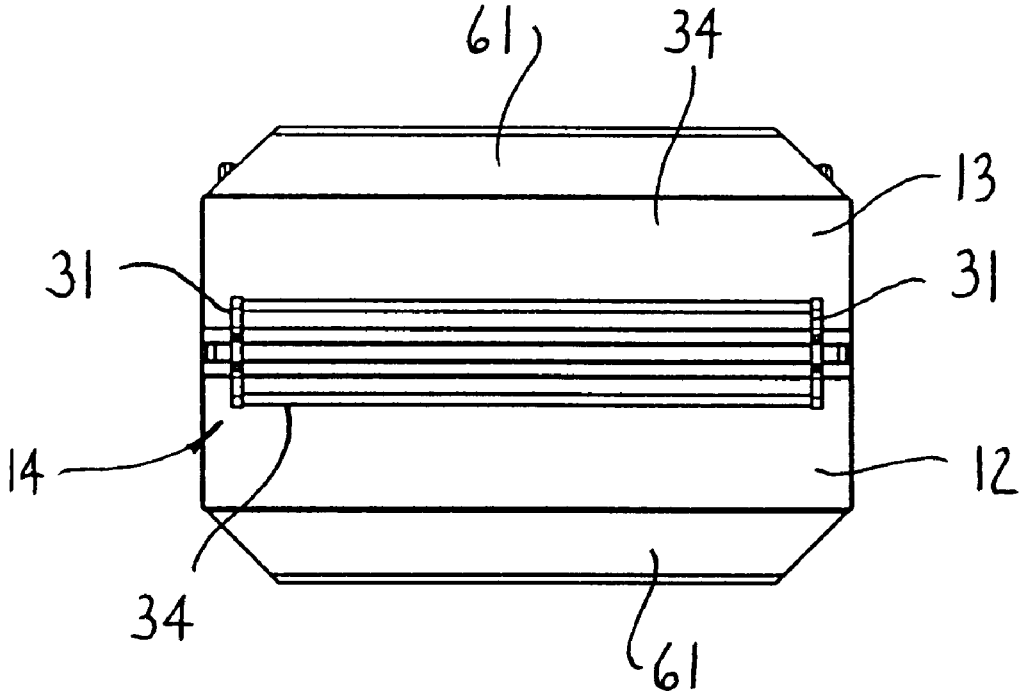
FIG. 5 is a top view thereof.

The display boards 12 and 13 are substantially identical and are disposed so as to be fixedly related to the base unit and project upwardly from the drawer support 26. Each display board 12, 13 is constructed generally as a substantially flat platelike member which is substantially rectangular in configuration so as to have generally parallel and horizontally extending lower and upper edges 28 and 29, the latter being joined by perpendicularly extending and substantially parallel side edges 27 which project dominantly vertically. The display boards 12, 13 are disposed so that the lower edges 28 extend generally longitudinally or lengthwise of the display unit 10 and are disposed in generally parallel but sidewardly spaced relation so that the lower edges 28 are spaced a significant distance apart and are respectively disposed adjacent opposite sides of the display unit as illustrated in FIG. 4. These lower edges 28 bear on the drawer support 26 adjacent the opposite lengthwise-extending sides edges thereof, with the lower edges of the display boards being suitably fixed to the drawer support 26 in any conventional manner, as by threaded fasteners such as screws projecting upwardly through the drawer support into the lower edges of the display boards.

The display boards 12 and 13, as shown by FIG. 4, are both disposed so as to project upwardly from the base, with each display board 12 and 13 being slightly sloped inwardly from the vertical toward the opposing display board. The two boards 12 and 13 thus slope inwardly toward one another as they project upwardly, whereby the two boards 12 and 13 when viewed from the end of the display unit 10 define therebetween a generally vertically elongated isosceles triangle with the upper edges 29 of the display boards being disposed substantially directly adjacent one another. The upper edges 29 are fixedly secured together by the bracket arrangement 14.

As illustrated by FIGS. 4–5 and 11–12, the bracket arrangement 14 includes a pair of bracket members 31 which are disposed adjacent the ends of the upper edges 29 of the display boards 12–13 and extend transversely thereacross. These bracket members 31 are suitably fixed to the display boards by fasteners such as screws 32 (FIG. 12) which are joined between the bracket members and upper edges of the display boards.

The upper bracket members 31 which join the upper edges of the boards 12–13 also preferably define a hanger structure for accessories, and for this purpose each bracket member 31 includes an arm part 33 which is cantilevered horizontally outwardly adjacent each end thereof so as to project outwardly beyond the adjacent front face of the display board. The outwardly projecting arm parts 33 associated with the pair of bracket members mounted adjacent opposite ends of the boards 12–13 are in turn rigidly joined together by an elongate hanger rod 34. This hanger rod 34 extends in generally parallel relation to the adjacent top edge of the display board, but is spaced forwardly a small distance from the adjacent front surface of the respectively adjacent display board to permit engagement with removable hanger units, as explained hereinafter. The bracket members 31 thus define and mount thereon a pair of said hanger rods 34, and one said rod 34 is disposed adjacent each side of the display unit so that a hanger rod is accessible from either side of the display unit.

Figure 6:
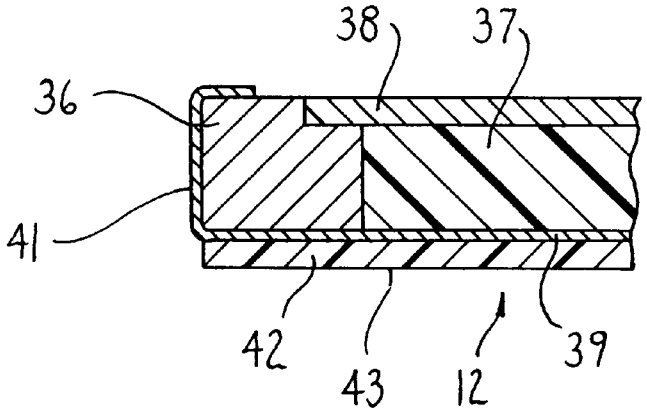
FIG. 6 is an enlarged fragmentary sectional view taken generally along line 6—6 in FIG. 3.

As to the construction of the display board 12, and its substantially identical counterpart display board 13, the board structurally includes a generally rectangular ringlike outer frame defined by a frame rail 36 (FIG. 6) which extends along each edge of the board. The opening defined by the interior of the frame rails 36 is closed by a substantially rectangular strengthening plate 37, the latter in the illustrated embodiment being of a generally rigid structural plastic foam. A suitable backing plate 38, such as a hardboard sheet, is fixedly adhered to the back side of the strengthening plate 37 and secured to the surrounding frame 36. The frame 36, plate 37 and backing plate 38 define a platelike support having the desired strength and rigidity for the display board. The platelike support 36, 37, 38 is in turn covered, on at least the front face thereof, by a thin metal plate 39, the latter preferably being a magnetically attractive metal, such as sheet steel. This sheet metal plate 39 preferably has the edge portions thereof bent to define edge flanges 41 which effectively exteriorly enclose the frame 36. The thin metal plate 39 is in turn covered, over the entire front face thereof, with a relatively thin surface layer 42, the latter defining a smooth and generally vertically enlarged front face 43, this being the exposed front face of the marker board. The layer 43 is a conventional material of the type used for making marker boards, being typically a plastic resin material which is suitably hard but defines thereon a smooth and typically white exterior surface which is suitable for use with conventional erasable ink marker pens. Such marker board material is conventional. The marker board layer 42 can be a preformed thin sheet which is laminated on to the thin metal plate 39, or in the alternative can be applied to the thin metal plate by other known techniques such as powder coating or spraying.

The triangular interior region disposed above the drawer support 26 and between the display boards 12–13 is provided with the article storage structure 15 associated therewith. This latter storage structure 15, in the embodiment illustrated by FIGS. 1–5, includes an upper storage region 51 (FIG. 4) which projects downwardly from the upper edges of the display boards and terminates at a generally horizontally extending support shelf 52 which extends transversely between and is rigidly joined to the rear side of the display boards approximately midway between the upper and lower edges thereof. This upper storage region 51 is preferably accessible from either end of the display unit, and can be used for storage of suitable articles therein, such as rolls of drawings or the like. This region 51 can also have additional divider or support structure positioned therein if desired so as to be suitable for storage with different types of articles or objects.

Figure 10:
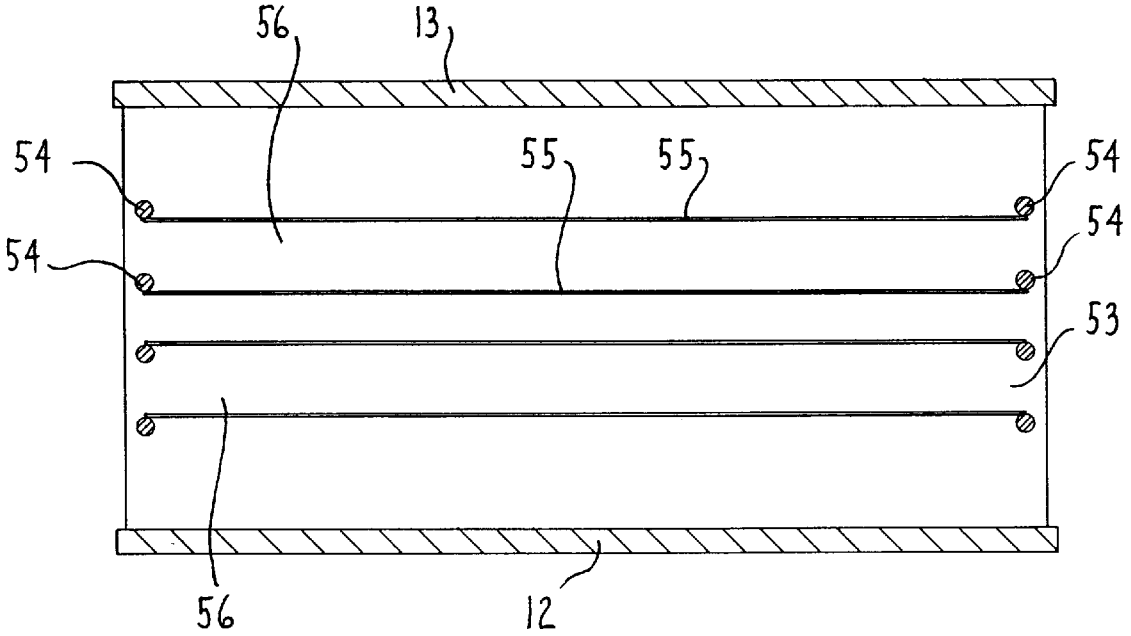
FIG. 10 is an enlarged fragmentary sectional view taken generally along line 10—10 in FIG. 3.

The article storage structure 15 also includes a lower storage region 53 which is disposed between the boards 12–13 and extend generally vertically between the intermediate shelf 52 and the drawer support 26. This lower storage region 53, as illustrated in FIGS. 4 and 10, has opposite ends thereof provided with a plurality of generally vertically upright dividers rods 54, the latter being disposed in sidewardly spaced and generally parallel relationship with opposite ends of the individual rods 54 being suitably fixed to the intermediate shelf 52 and the drawer support 26. These rods 54, and their presence adjacent opposite ends of the display unit, cause the lower storage region 53 to be subdivided into a plurality of sidewardly adjacent subcompartments 56, which subcompartments are sidewardly narrow but are of significant vertical height, and extend longitudinally throughout the length of the display unit, thereby accommodating storage of large sheetlike objects or articles therein. If desired or necessary, the adjacent subcompartments 56 can be more effectively isolated from one another by providing sheetlike divider screens 55 disposed so as to be joined to and extend longitudinally between the longitudinally aligned divider rods 54 disposed adjacent opposite longitudinal ends of the display unit. These divider screens 55 may be formed in many different fashions, such as by fabric sheets, or by any other suitable structure which provides the desired degree of isolation between adjacent subcompartments 56.

Figure 8:
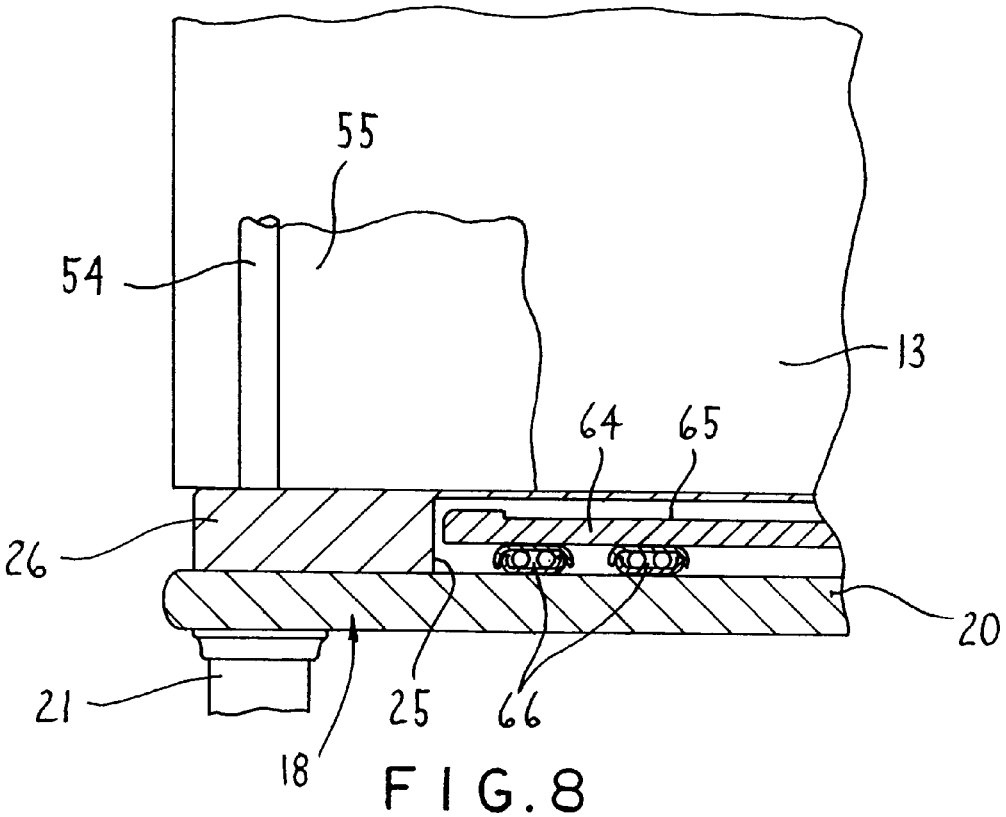
FIG. 8 is a fragmentary sectional view taken generally along line 8—8 in FIG. 7.
Figure 7:
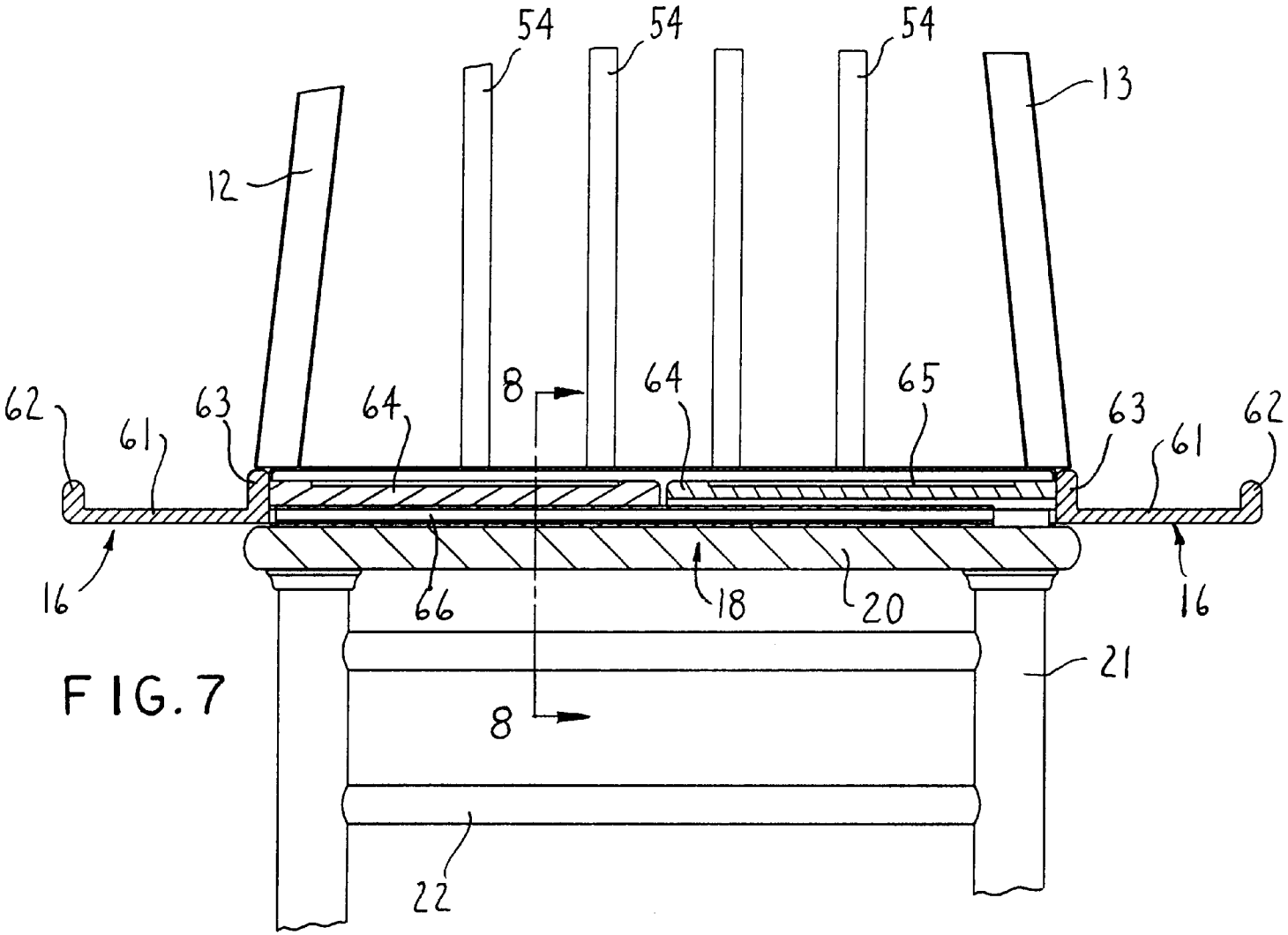
FIG. 7 is an enlarged fragmentary sectional view taken generally along line 7—7 in FIG. 3.
Figure 9:
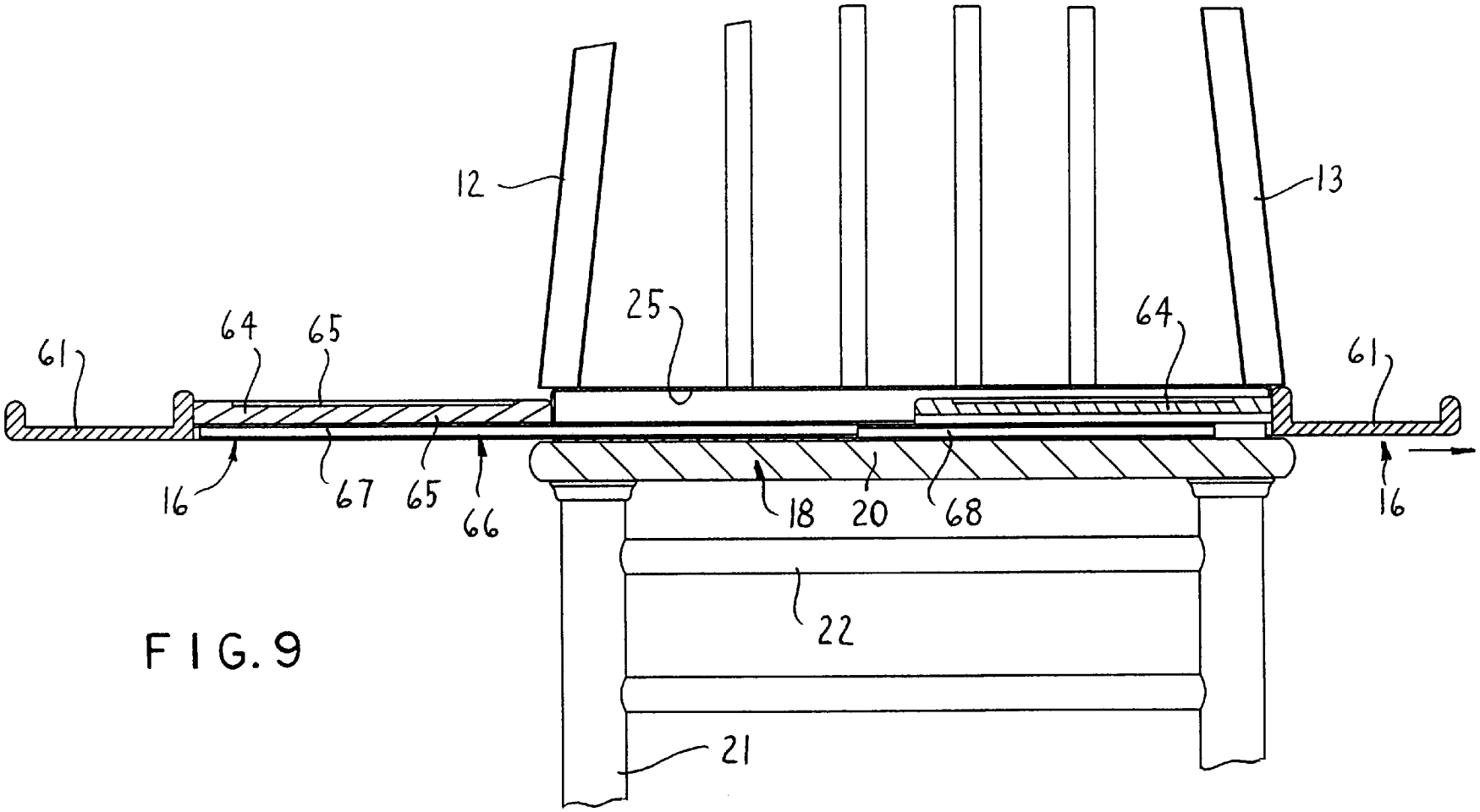
FIG. 9 is a fragmentary sectional view similar to FIG. 7 but showing one of the tray assemblies in an open or extended position.

Considering now the slidable tray arrangement 16, reference is made to FIGS. 7–9 which illustrates that a pair of such slidable tray arrangements 16 are provided, one such tray arrangement 16 being provided adjacent each side of the display unit so as to be positionable adjacent the lower edge of the respectively adjacent display board 12 or 13.

Each slidable tray arrangement 16 includes an elongate outer tray 61 which extends longitudinally along one side of the display unit throughout substantially the entire length of the respectively adjacent marker board directly adjacent the lower edge 28 thereof. The outer tray 61 is preferably of a shallow, upwardly-oriented channel-like cross section and includes an upwardly-projecting front flange 62 extending longitudinally along the outer edge thereof. The tray also has an upwardly-projecting rear flange extending longitudinally thereof, whereby these flanges 62 and 63 define a recess or pocket to permit stable confinement therein of the accessories traditionally used with a marker board, such as ink marker pens, erasers and the like. The rear flange 63 is sized so that it normally is positioned generally within the mouth of the cutout 25 which extends transversely through the drawer support 26 when the slidable tray arrangement 16 is in the closed position as illustrated by FIG. 7. This positions the outer tray 61 directly adjacent the lower front edge of the marker board for convenient access thereto.

The slidable tray arrangement 16 also includes an elongate inner support tray 64 which is fixed to and projects generally horizontally inwardly from the rear flange 63 for storage within the cutout 25. This inner support or storage tray 64 is longitudinally elongate so as to extend substantially the length of the cutout 25, and the tray 64 has a width which, as illustrated in FIG. 7, is approximately one-half of the sideward width of the display unit, as determined by the sideward width of the top shelf 18 and tray support 26. The inner tray 64 has a width which is greater than the width of the outer tray 61, and this tray 64 defines thereon an enlarged upper surface which is usable for supporting objects such as papers thereon when the inner tray 64 is in the outer position illustrated by FIGS. 2 and 9. The upper surface of the inner tray 64 is, in the illustrated embodiment, provided with a shallow recess 65 therein to facilitate the supporting of objects or articles thereon.

Each tray assembly 16 is movably and more specifically slidably supported for sideward linear movement between open and closed positions by a pair of conventional ball-slide units 66, the latter typically being referred to as "drawer slides". At least two such slide units 66 are disposed for association with each tray arrangement 16, with the slide units being disposed in generally parallel but longitudinally spaced apart relationship to extend sidewardly or transversely of the display unit. As illustrated by FIGS. 7 and 9, each slide unit 66 has an upper elongate slide rail 67 which is fixed to the underside of the inner tray 64 and this upper slide rail 67 is in turn longitudinally slidably supported through a conventional ball carriage (not shown) on an elongate lower rail 68, the latter being fixedly secured to the upper surface of the top shelf 20. The slide units 66 are preferably provided with a length greater than the front-to-back width of the inner tray 64 so as to provide sufficient opening movement to allow the entire width of the inner tray 64 to be moved into an open and accessible position substantially as illustrated by FIG. 9. This thus requires that the slides 66 which connect to the leftward tray 64 in FIG. 9 be longitudinally staggered relative to the slides which connect to the rightward tray 64 in FIG. 9. The slide units 66 which are fixed to the leftward tray 64 in FIG. 9 project under but are not joined to the rightward tray 64 in FIG. 9, with the slide units which joins to the rightward tray 64 in FIG. 9 also projecting leftwardly under but are not joined to the leftward tray 64.

Figure 11:
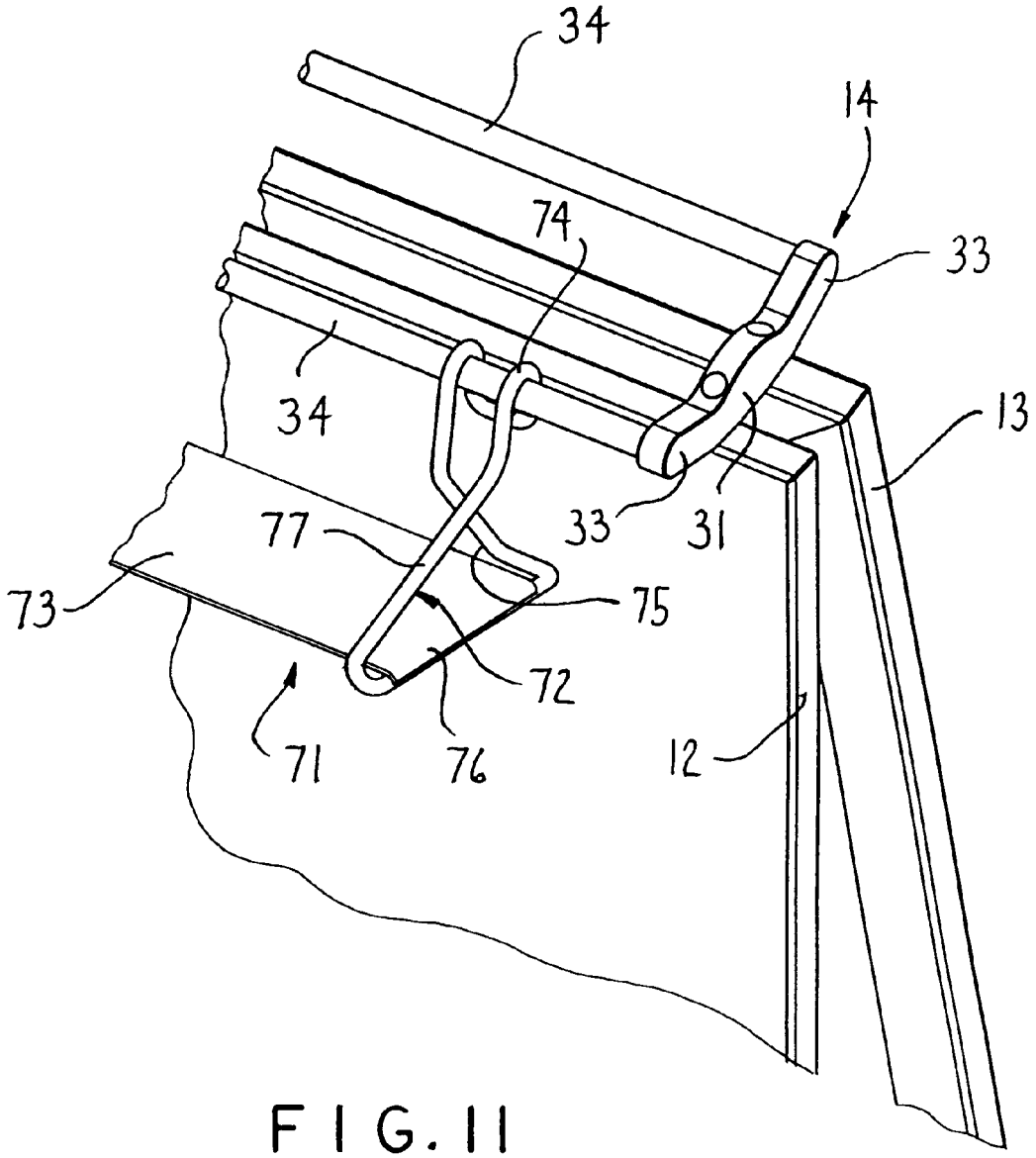
FIG. 11 is a fragmentary perspective view showing the bracket and hanger arrangement associated with the top of the marker board arrangement, and illustrating one type of hanger unit attached thereto.
Figure 12:
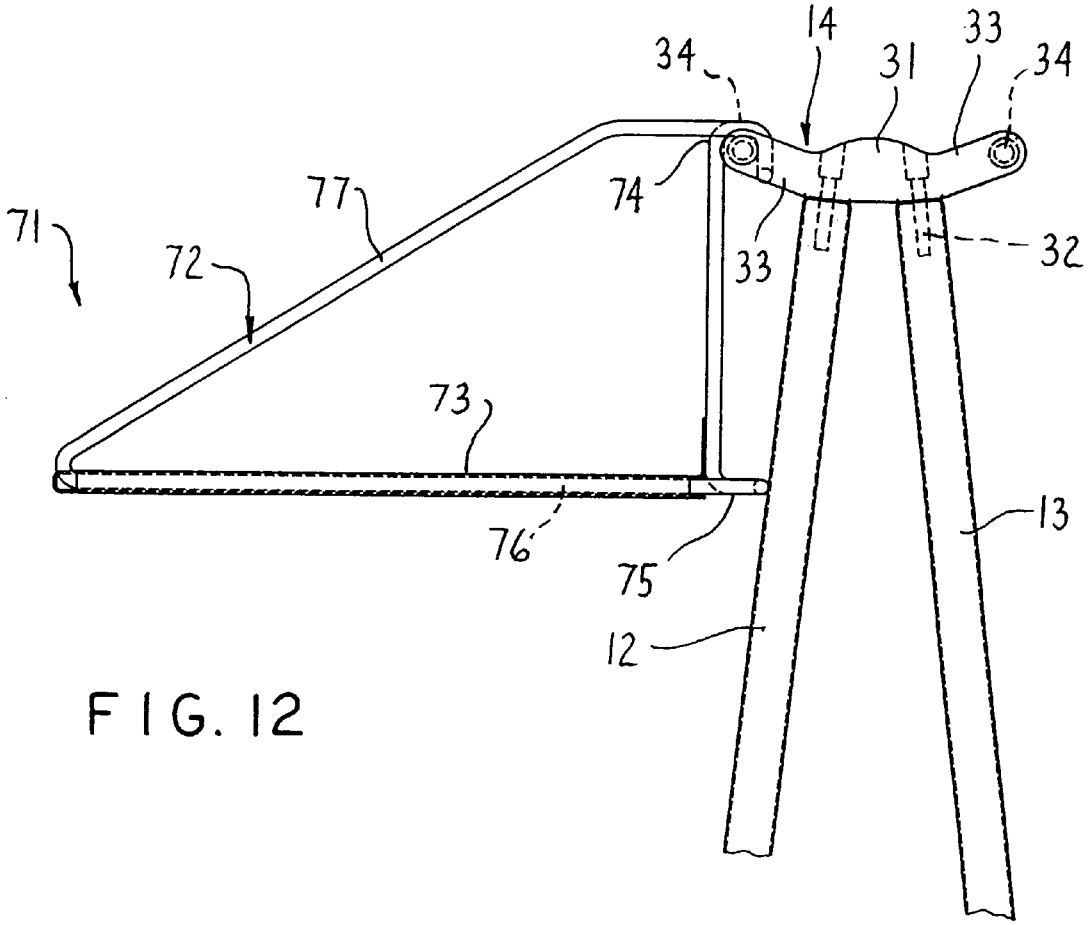
FIG. 12 is a fragmentary end elevational view of the arrangement shown in FIG. 11.

Considering now the hanger structure provided adjacent and extending longitudinally along the upper edges of the display boards 12–13, the hanger rods 34 are provided so as to engageable with a plurality of different types of hanger units. One such hanger unit 71 is illustrated in FIGS. 11 and 12, which hanger unit 71 is a shelf unit. The shelf unit 71 is defined by a pair of substantially identical hangers 72 (only one shown in the drawings) which releasably attach to the hanger rod 34 in longitudinally spaced relation therealong. The pair of spaced hanger units 72 in turn are joined by a shelf member 73 which extends longitudinally therebetween. The shelf 73 defines thereon a generally planar and upwardly-facing surface for support or display of objects or papers or other suitable articles which are typically lightweight. The hanger 72 in the illustrated embodiment is conveniently formed generally in one piece by being bent from an elongate wire rod, and includes an upper hook part 74 which has a generally arcuate hooklike shape adapted to hang over the rod 34. The hook part 74 projects downwardly for connection to an abutment part 75 which is adapted to abut against the front face of the display board to provide stability. The abutment part 75 then joins to an outwardly projecting support part 76, the latter being engaged with one end of the shelf 73, and the outer end of the support part 76 in turn joins to a reinforcing part 77 which angles upwardly and inwardly for reconnection to the hook part 74.

The hangers 72 can be permanently fixed to opposite ends of the shelf 73, but more desirably are releasably attached to opposite ends of the shelf 73, the latter preferably having hooklike channels on opposite ends thereof for engagement with the support parts 76 to facilitate handling and storage of the components. This also enables the hangers 72 to be usable with other objects or for other functions.

Figure 13:
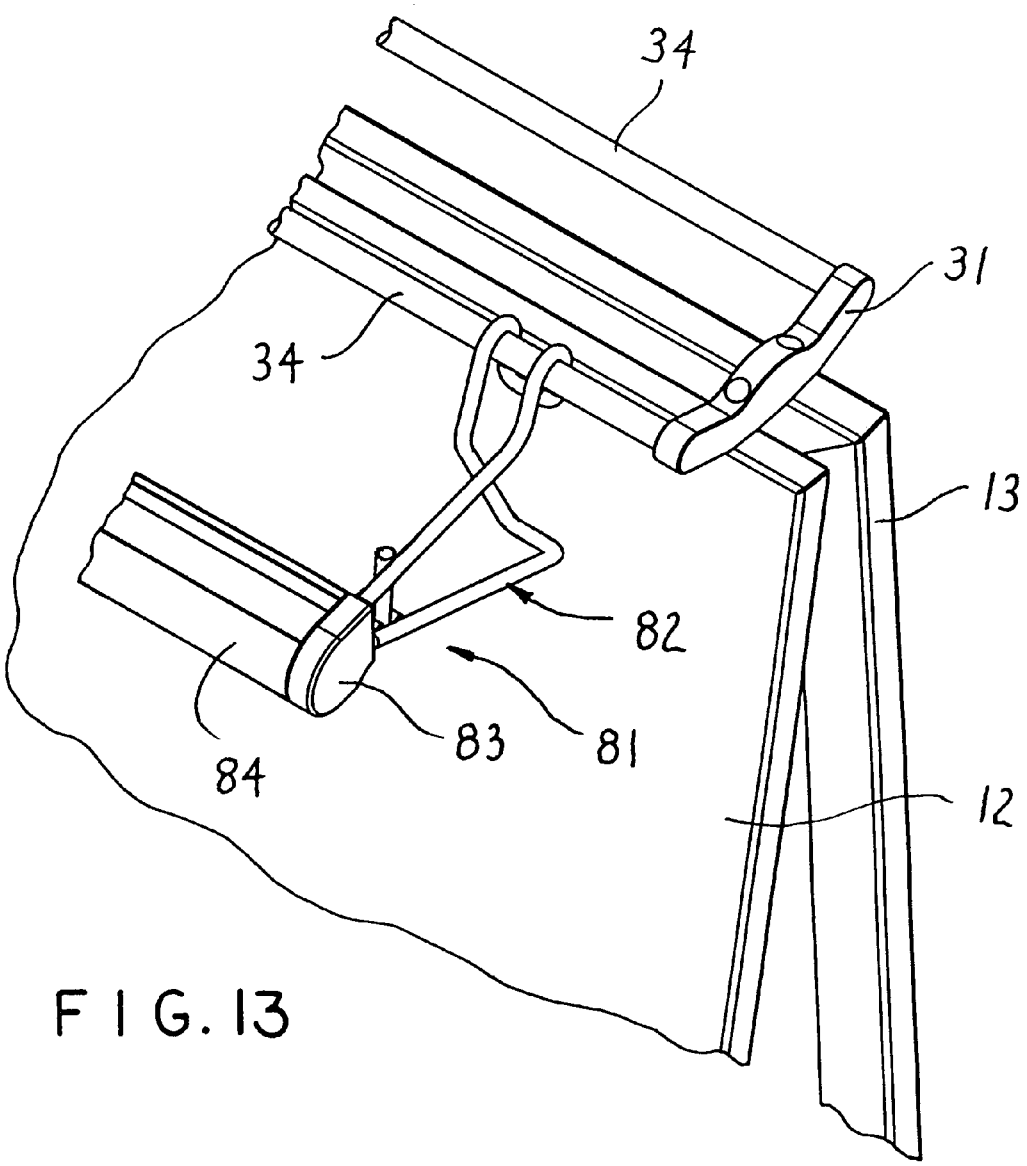
FIG. 13 is a fragmentary perspective view similar to FIG. 11 and showing an alternate removable hanger unit associated with the top hanger rods.
Figure 14:
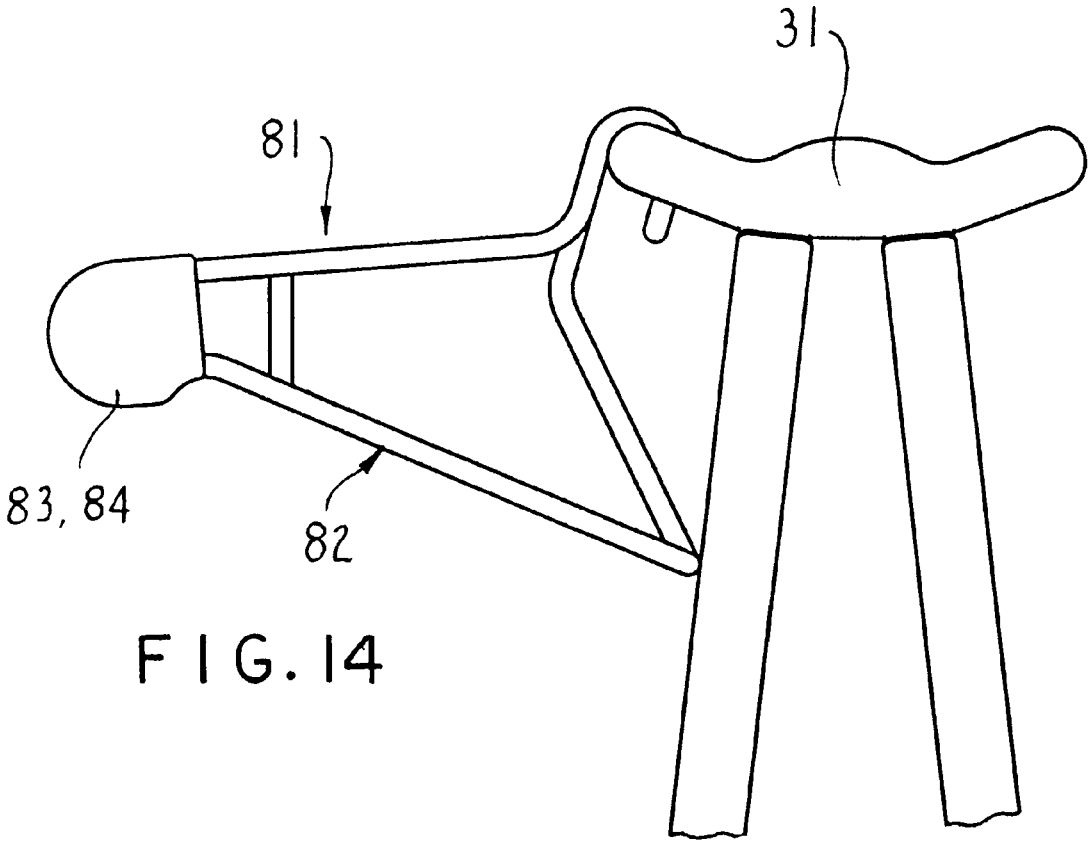
FIG. 14 is a fragmentary end elevational view of the arrangement shown in FIG. 13.

FIGS. 13–14 illustrate another type of hanger unit 81 which can be detachably engaged on one of the hanger rods 34. The hanger unit 81 is in many respects similar to the hanger unit 71 in that it again includes a pair of individual hangers 82 which hook on to the rod 34 in longitudinally spaced relation, and the hangers 82 in this embodiment have a construction similar to the hangers 72 described above but the outer ends of the hangers 82 have a bracket structure 83 associated therewith which enables a horizontally elongated roll-up screen unit 84 to be mounted on and extend between the longitudinally spaced brackets 83. The screen unit 84 may be a conventional screen of the type used for projecting photographic images thereon, or may be any other conventional type of roll-up screen or sheetlike flexible member.

It will be appreciated that the hangers 72 and 82 can be constructed many different ways while still functioning in the manner described above, and that numerous other types of hanger units can also be provided for removable attachment to and support from the hanger rods 34.

Figure 15:
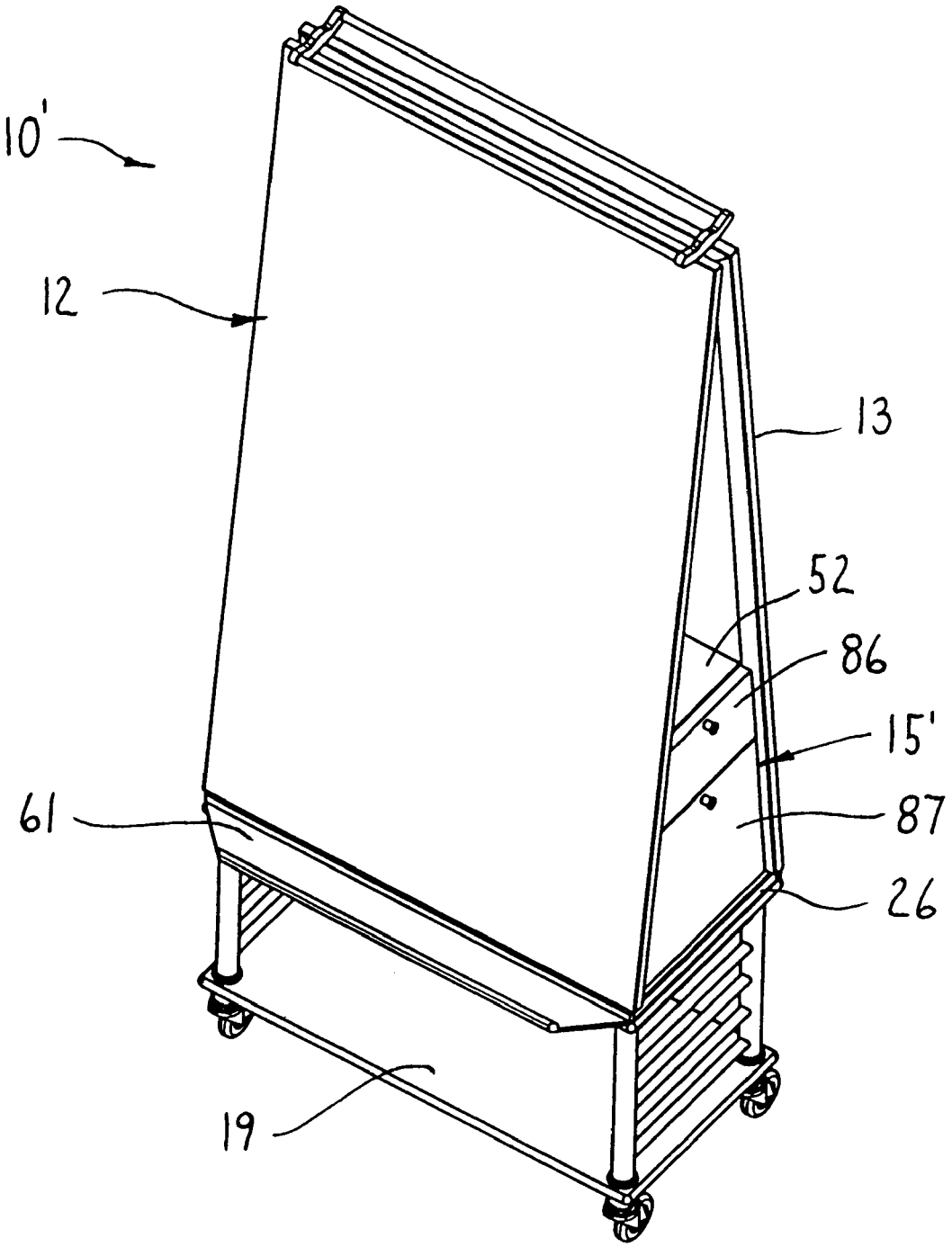
FIG. 15 is a perspective view similar to FIG. 1 but illustrating an alternate interior storage structure associated with the mobile marker board arrangement.
Figure 17:
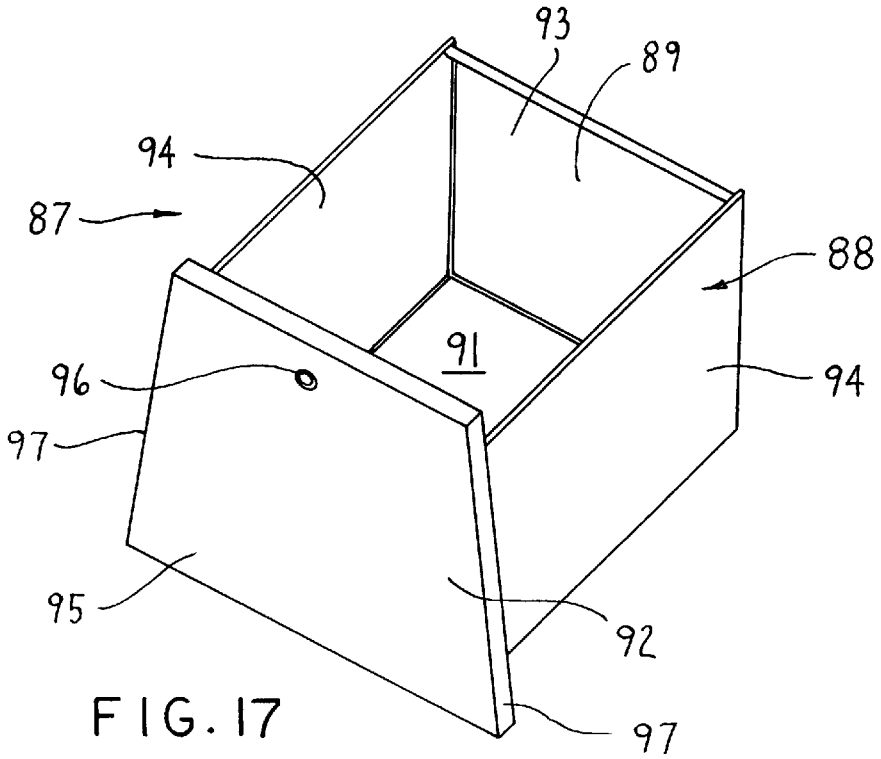
FIG. 17 is a perspective view of solely the lower storage drawer of FIG. 16.
Figure 16:
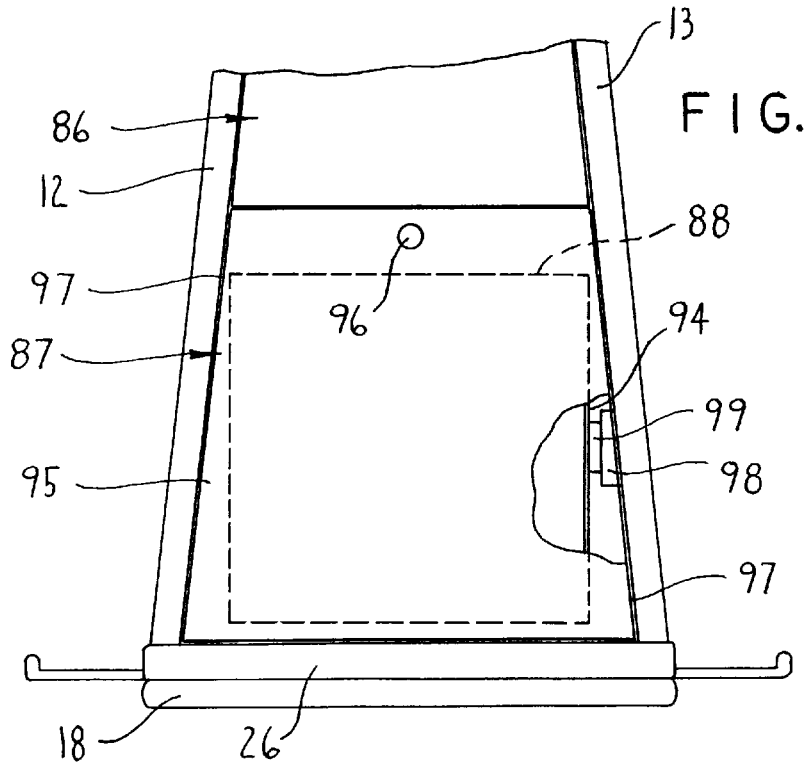
FIG. 16 is a fragmentary enlarged end elevational view of the alternate interior storage structure of FIG. 15.

Referring now to FIGS. 15–17, there is illustrated a variation of a mobile display unit 10' according to the present invention, which display unit 10' incorporates all of the same structural and functional relationships possessed by the unit 10 described above except that the unit 10' incorporates a modified article storage structure 15' therein.

More specifically, the article storage structure 15' of this invention includes a plurality, specifically two in the illustrated embodiment, of openable storage drawers associated with the lower storage region 53 as defined between the intermediate shelf 52 and the drawer support 26. In this lower region there is provided upper and lower storage drawers 86 and 87, respectively, one being disposed generally directly above the other. The lower storage drawer 87, as illustrated by FIGS. 16–17, includes a boxlike housing or structure 88 which is open on the top side thereof to provide access to an interior storage compartment 89. This boxlike structure 88 includes a generally horizontal bottom wall 91 which is fixedly joined to generally parallel and upwardly-projecting front and rear wall 92 and 93, the latter in turn being rigidly joined to generally parallel and vertically projecting side walls 94. The front wall 92 overlies and is fixedly secured to the rear surface of a vertically enlarged platelike drawer front 95, the latter having a suitable drawer pull 96 associated with the outer face thereof. The drawer front 95, as shown in FIG. 16, is generally four-sided and includes generally top and bottom edges which are generally parallel and horizontal, and are joined together by opposite side edges 97, the latter being sloped inwardly as they project upwardly, whereby the side edges 97 define a converging angular relationship as they project upwardly, which converging angular relationship corresponds to the inner surfaces of the display boards 12 and 13. This enables the drawer front 95, when moved into the closed position, to effectively move between the rear surfaces of the display boards directly adjacent the side edges thereof, substantially as illustrated by FIGS. 15–16. The drawer front thus has a symmetrically converging tapered shape as it projects upwardly so as to be compatible with the configuration of the interior space defined between the boards 12–13.

To slidably support the drawer 87 for movement between open and closed position, each side wall 94 of the drawer housing has one rail of an elongate ball-type drawer slide 99 fixed thereto and extending horizontally therealong, which drawer slide has the other horizontally elongate rail thereof fixed to an elongate support block 98 fixed to the inner or rear surface of the respective display board 12–13. The drawer slides, which are conventional and well known, incorporate conventional stops for defining the contracted and extended positions of the drawer slides, enable the drawer unit 87 to be manually slidably extended from the closed position illustrated in the drawings wherein it is disposed entirely in the interior between the marker boards 12–13, to an outward extended position so as to provide convenient access to the interior storage compartment 89.

The upper drawer unit 86 is constructed and slidably mounted on the display boards 12–13 in substantially the same manner as the lower drawer unit 87, and again includes a drawer front which also has a symmetrical upwardly-converging shape so as to fit within and be compatible with the convergent interior region defined between the boards 12–13. Each drawer unit 86 and 87 is independently manually slidable between open and closed positions.

In the embodiment of the display unit 10' illustrated by FIG. 15, separate upper and lower drawer units 86–87 are preferably provided adjacent and accessible from each end of the display unit 10', and for this purpose each drawer unit 86, 87 has a length which approximately corresponds to one half the longitudinal length of the display unit. However, it will be recognized that longer drawer units can be provided if necessary or desired, and that the drawer units may be accessible from only one end of the display unit 10.

As a still further alternative, the display unit can be provided with the drawer-storage unit 15' associated with one end thereof and projecting inwardly approximately one half the longitudinal length of the display unit, and the other end of the display unit can be provided with the storage unit 15 of FIG. 1.

The display units 10 and 10' as illustrated by FIGS. 1 and 15 and as described above have a longitudinal length which is significantly less than their height. For example, and merely as illustrative of the invention, the display boards 12–13 for the display units 10 and 10' have a longitudinal or horizontal length of about 30 inches, and a height of about 60 inches. It will be appreciated, however, that the dimensions of the display or marker board, both horizontally and vertically, can be modified in accordance with desired or optimum use parameters. In this regard, reference is made to FIGS. 18–19 which illustrate a further embodiment of a display unit 10" according to the present invention. In the display unit 10" the display boards, such as illustrated by the marker board 12", is of increased longitudinal length. In this embodiment, solely for purposes of example, the marker board is approximately 60 inches long and 60 inches high.

Figure 18:
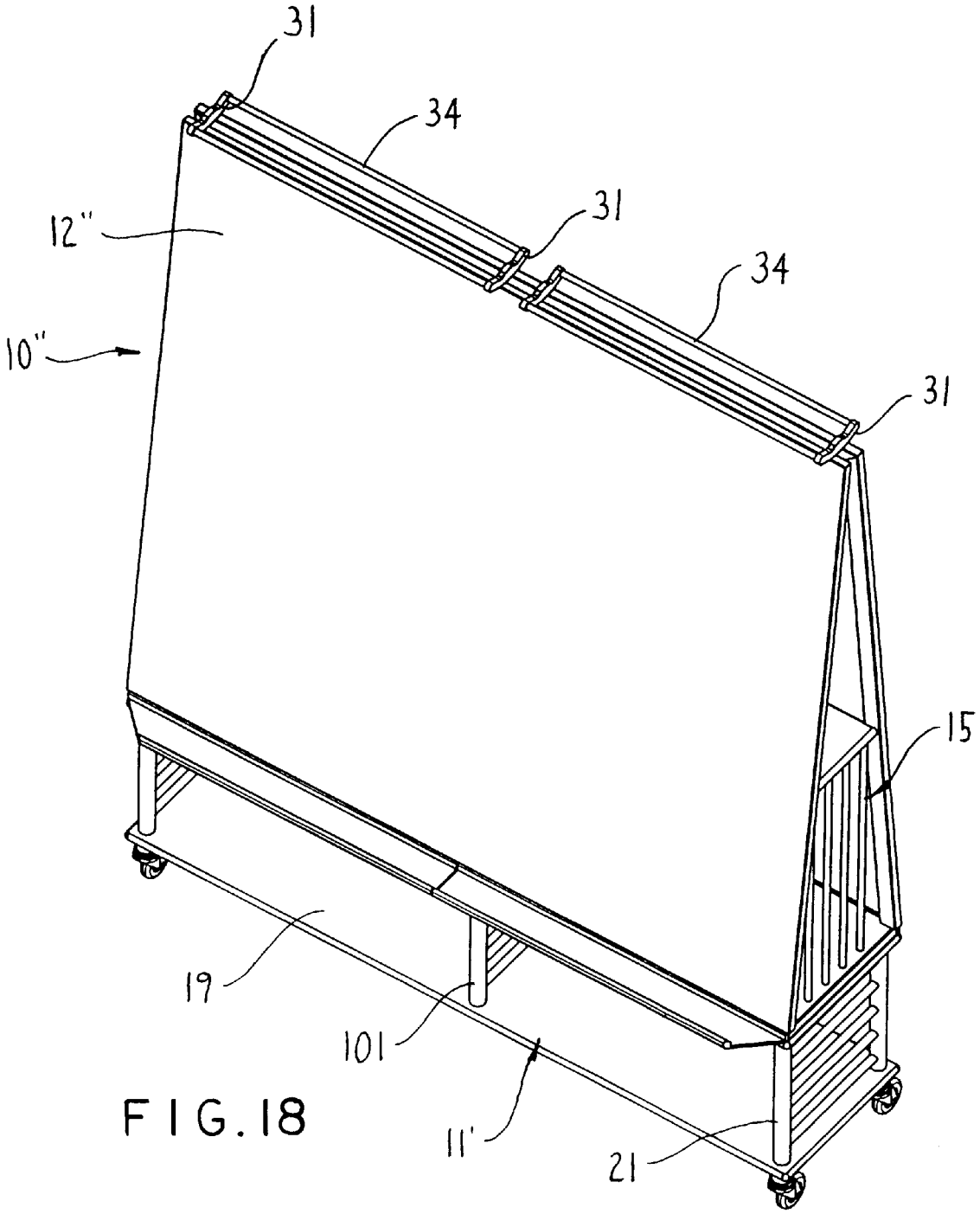
FIG. 18 is a perspective view of a modified mobile marker board arrangement of the present invention, which modified arrangement is of increased length and incorporates therein the interior storage structures associated with the arrangements of both FIGS. 1 and 15.
Figure 19:
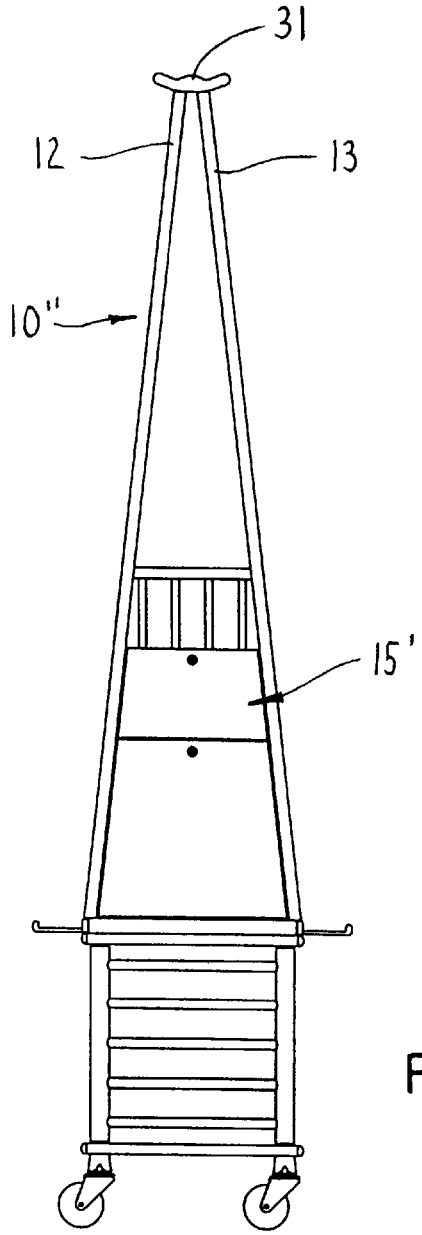
FIG. 19 is a left end elevational view of the arrangement illustrated in FIG. 18.

This larger-size display unit 10" includes all of the same structural and functional relationships which have been described above, and hence will not be repeated. Because of this increased length, however, the base 11" does include an additional pair of intermediate upright support posts 101 to provide additional reinforcement between the upper and lower base shelves. Further, with this longitudinally longer unit 10", one end of the interior storage region can be provided with one type of interior article storage, such as the article storage 15 as depicted in FIG. 18, and the other end can be provided with a different type of article storage, such as the drawer-type storage 15' as depicted in FIG. 19. In this variation, additional top bracket members 31 are also preferably provided to provide additional strength and rigidity where the upper edges of the marker boards are joined together, and the provision of these additional brackets does permit the upper hanger rods 34 to be defined either as individual rods which extend between longitudinally adjacent pairs of brackets, or alternatively if desired a single continuous elongate rod can be utilized.

Figure 20:
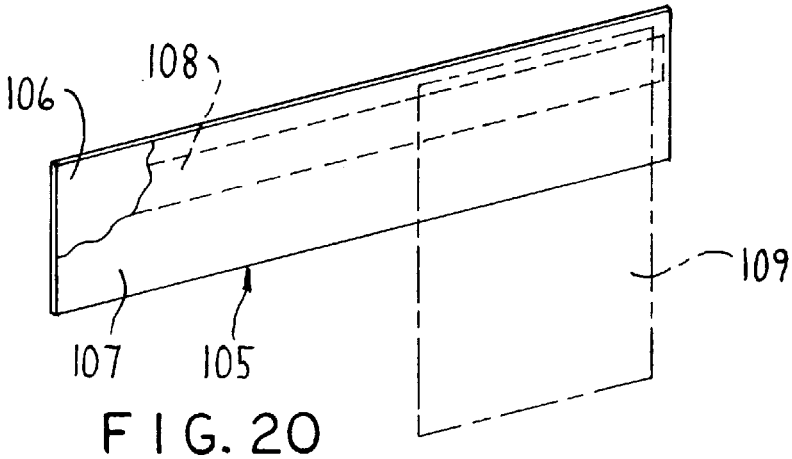
FIG. 20 is a perspective view of a removable magnetic support member which is attachable and usable with the embodiments of the marker board arrangement.

The display unit 10, 10' or 10" of this invention is also preferably provided with magnetic article supports for attachment to the face of the marker board, one such magnetic article support plate 105 being illustrated in FIG. 20. The magnetic article support plate is preferably formed as a thin platelike member and preferably has a horizontally elongated striplike shape as indicated by FIG. 20. This magnetic support plate 105 includes a thin sheetlike base plate 106 formed from a conventional magnetic plastic material (i.e., a plastic resin having magnetized articles therein) which is commercially available as a thin and flexible sheetlike material conventionally provided in rolls or the like. Such magnetic strip 106 is preferably provided with a thin facing sheet 107 on the front face thereof, such as a vinyl sheet. The front face of the plate 105, namely the exposed face of the facing sheet 107, has a coating or layer of a pressure sensitive adhesive thereon which is typically provided at least along an elongate striplike area 108 associated with the front face of the strip 105. The adhering coating material 108 is generally similar to the type of material which is applied to conventional "Post-It" notes in that it permits papers 107 and the like to be readily attached to and supported therefrom, or detached therefrom, with the magnetic support strips 105 and the adherence coating 106 thereon being readily reusable over long periods of time for permitting temporary attachment thereto of sheetlike articles such as drawings or other papers.

Inasmuch as each marker board 12, 13 has a metal layer disposed beneath the outer mark board layer, the magnetic properties of the support strip 105 enable it to be magnetically attracted to and snugly engaged against the front face of the marker board, substantially as depicted by FIG. 3, and various sheetlike objects 109 can then be detachably but temporarily secured thereto so as to permit the marker board to be used in conjunction with other visual display media such as drawings or the like, while at the same time still retaining part of the front face of the marker board for use with conventional ink marker pens.

It will be appreciated that totally separate magnets, such as refrigerator magnets, could be utilized with the marker board of this invention, in which case the paper would be positioned directly adjacent the front face of the marker board and then the magnet applied over the face of the paper to hold it in position. Such is less convenient, however, since such operation basically requires two hands, and requires a greater number of individual small magnets. With the improved magnetic attaching strips 105 of this invention, several strips can be attached on the surface of the marker board and left in position, and then individual sheets can be readily attached to and removed from the various magnetic strips, which function can be readily accomplished using one hand. Further, the face of the sheet is not obstructed by the magnetic strips 105.

The display unit is preferably provided with a plurality of magnetic attachment strips or members 105, which magnetic attachment members may have whatever shape of configuration desired. The magnetic attachment strips 105, when not in use, can be readily stored directly on the display unit, for example such strips can be stored either in the drawers or in the subcompartments defined between the upright divider rods 54 if desired. Alternatively, the interior storage space between the boards 12–13 can be provided with upper and lower brackets having suitable notches therein so as to permit the individual magnetic strips to be stored interiorly by being positioned side-by-side with upper and lower edges thereof suitably engaged by upper and lower notched brackets.

The structure and function of the display unit according to the present invention, and the multifaceted mode of operation and flexibility of use achievable therewith, is believed apparent from the description presented above. Further detailed explanation thereof is believed unnecessary.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A mobile display unit comprising:

a wheeled base having upper and lower supports disposed in vertically spaced relation and defining an open storage region therebetween, said storage region having at least one open side which opens sidewardly and is accessible from one side of said wheeled base, said lower support comprising a shelflike member which extends inwardly away from said open side to define an upward facing support surface and is provided with rolling elements mounted on an underside thereof adjacent corners of said shelflike member for rolling engagement with a floor;

a pair of enlarged platelike display boards fixedly mounted on said base and projecting upwardly from said upper support, said pair of display boards being disposed generally in back-to-back relationship so that a front face of one said display board faces sidewardly of said unit in one direction and a front face of the other said display board faces sidewardly of said unit in the opposite direction;

at least one of said display boards having at least an outer surface layer which defines said front face, said outer surface layer being of a synthetic resin so that said front face is a substantially planar and flat smooth surface capable of functioning as a marker board for permitting writing thereon with eraser ink marker pens; and a substantially upwardly-facing tray assembly movably supported on said base directly adjacent a lower horizontally extending edge of said one marker board so as to be disposed above said storage region, said tray assembly being horizontally sidewardly movable relative to said base between retracted and extended positions;

said tray assembly including an outer longitudinally elongate tray which is positioned directly adjacent and projects sidewardly outwardly from and horizontally longitudinally along said one display board adjacent the lower edge thereof when said tray assembly is in said retracted position, said tray assembly also including an inner upwardly-facing tray which is longitudinally elongated of said unit and which is fixed to and projects sidewardly and inwardly from said outer tray so as to be stored generally rearwardly of said one display board when said tray assembly is in said retracted position, said tray assembly being horizontally movable sidewardly of said unit into said extended position wherein said inner tray is positioned adjacent and extends generally longitudinally along the lower edge of said one display board and projects generally horizontally outwardly therefrom.

2. A display unit according to claim 1, wherein said one display board includes a thin layer of magnetically attractable metal disposed coextensively under said outer surface layer, and a plurality of thin sheetlike magnetic plastic article supports removably engageable with the front face of said one display board due to magnetic attraction of said article supports with said metal layer, said article support having an outer face provided with a coating of an adhering material thereon which permits paper sheets to be releasably attached thereto.

3. A display unit according to claim 1, wherein said pair of display boards have the lower horizontally extending edges thereof positioned in sidewardly spaced relation so as to define an article storage region between said display boards, and article support structure positioned within said region and cooperating between opposed rear surfaces of said pair of display boards for permitting support or storage of articles.

4. A display unit according to claim 3, wherein said article storage structure includes at least one drawer unit which is positioned within said interior region adjacent the lower edges of said display boards and is supported for horizontal slidable movement between a storage position wherein the drawer unit is disposed generally between said pair of display boards and an open position wherein the drawer unit projects horizontally outwardly from said storage region beyond adjacent end edges of said display boards.

5. A display unit according to claim 1, wherein said pair of display boards have lower longitudinally extending edges thereof disposed in sidewardly spaced relation with said display boards converging toward one another as they project vertically upwardly so that upper horizontally extending edges of said display board are disposed sidewardly in closely adjacent relationship, whereby said display boards define an interior region therebetween which when viewed in a vertical plane perpendicular to the longitudinal direction of the unit has a configuration which resembles an isosceles triangle.

6. A display unit according to claim 5, wherein said other display board has the front face thereof defined by an outer surface layer substantially identical to said one display board so that the front face of said other marker board also functions as a marker board for use with erasable ink marker pens.

7. A display unit according to claim 6, including a second horizontally extendible tray assembly positioned adjacent and extending generally longitudinally along said base directly adjacent the lower horizontal edge of said other display board, said second tray assembly being substantially identical to said first-mentioned tray assembly and including an outer tray which is positioned adjacent and projects outwardly of and longitudinally along the other display board adjacent the lower edge thereof when the second tray assembly is in a retracted position, said second tray assembly including an inner tray fixed to and projecting inwardly from said outer tray and being normally stored interiorly of said base, said inner support tray being positioned adjacent and projecting outwardly of and extending longitudinally along said base adjacent the lower edge of said other display board when the second tray assembly is in an extended position.

8. A display unit according to claim 1, wherein said upper support of said base is of a generally horizontally enlarged platelike construction, said base including a pair of end walls which are disposed adjacent opposite longitudinal ends of said base and project vertically between and fixedly join said upper and lower supports in vertically spaced relation, the storage region between said upper and lower supports, as it extends longitudinally of said base between said end walls, being open and accessible from both longitudinally extending sides of said base.

9. A mobile display unit comprising:

a wheeled base having upper and lower supports disposed in vertically spaced relation and defining a storage region therebetween, said storage region being accessible from at least one side of said wheeled base, said lower support comprising a shelflike member provided with rolling elements mounted on an underside thereof adjacent corners thereof for rolling engagement with a floor;

a pair of enlarged platelike display boards fixedly mounted on said base and projecting upwardly from said upper support, said pair of display boards being disposed generally in back-to-back relationship so that a front face of one said display board faces sidewardly of said unit in one direction and a front face of the other said display board faces sidewardly of said unit in the opposite direction;

at least one of said display boards having at least an outer surface layer which defines said front face, said outer surface layer being of a synthetic resin so that said front face is a substantially planar and flat smooth surface capable of functioning as a marker board for permitting writing thereon with eraser ink marker pens;

a substantially upwardly-facing tray assembly movably supported on said base directly adjacent a lower horizontally extending edge of said one marker board, said tray assembly being horizontally sidewardly movable relative to said base between retracted and extended positions, said tray assembly including an outer longitudinally elongate tray which is positioned directly adjacent and projects sidewardly outwardly from and horizontally longitudinally along said one display board adjacent the lower edge thereof when said tray assembly is in said retracted position, said tray assembly also including an inner upwardly-facing tray which is longitudinally elongated of said unit and which is fixed to and projects sidewardly and inwardly from said outer tray so as to be stored generally rearwardly of said one display board when said tray assembly is in said retracted position, said tray assembly being horizontally movable sidewardly of said unit into said extended position wherein said inner tray is positioned adjacent and extends generally longitudinally along the lower edge of said one display board and projects generally horizontally outwardly therefrom; and bracket means extending transversely between and fixedly joined to horizontally extending upper edges of said display boards for fixedly joining said display boards together, said bracket means including a horizontally elongate hanger rod which is spaced outwardly from the front face of at least one said display board and extends generally horizontally and longitudinally therealong for permitting separate removable hanger units to be suspended therefrom in the vicinity of the front face of said one display board adjacent the upper edge thereof.

10. A display unit according to claim 9, wherein said bracket means includes a bracket mounted to said upper edges of said display boards to join said display boards together, said bracket including arm parts which project outwardly away from said front faces of said display boards and support said hanger rods in outwardly spaced relation with said front faces.

11. A display unit according to claim 10, wherein said bracket means includes a plurality of said brackets wherein said brackets are spaced apart along said upper edges so as to support spaced apart sections of said hanger rod.

12. A display unit according to claim 10, which includes at least one hanger unit suspended from said bracket means, said hanger unit including a hook part which hooks onto said hanger rod and an abutment part suspended downwardly from said hook part, said abutment part abutting against a corresponding one of said front faces of said display boards when said hanger unit is suspended from said hanger rod.

13. A display unit according to claim 12, wherein a plurality of said hanger units are provided in spaced apart relation, said hanger units being joined together by an upward-facing support surface extending horizontally therebetween.

14. An upright mobile display unit, comprising:

a wheeled base;

first and second enlarged and platelike display boards mounted on and projecting upwardly from said base in generally back-to-back relation so that said pair of display boards define thereon enlarged and substantially flat outer front faces which face sidewardly in opposite directions, said display boards being mounted so that lower and generally horizontally extending edges thereof are positioned in sidewardly spaced relation relative to said base, said first and second display boards projecting vertically upwardly from said lower edges and each being angled sidewardly toward the other display board so that generally horizontally extending upper edges of said first and second display boards are positioned sidewardly closely adjacent one another, and bracket structure fixedly joined between said first and second display boards in the vicinity of said upper edges, said first and second display boards defining an interior storage region therebetween which extends longitudinally of said display unit and is accessible from at least one end thereof;

storage structure positioned within said interior region adjacent at least said one end thereof and cooperating with back surfaces of said first and second display boards for permitting supportive storage of articles within said storage region;

each said display board including an outer sheetlike surface layer which is of a synthetic resin material so that said outer front face has a smooth and light colored surface capable of writing thereon with erasable ink marker pens;

first and second longitudinally elongate trays positioned adjacent the lower edges of the respective first and second display boards and projecting longitudinally therealong, said first and second trays projecting outwardly relative to the respective display board and defining an upwardly-facing support surface for supporting marker board utensils thereon;

each of said first and second trays having an inner tray fixedly joined thereto and projecting inwardly for storage behind the respective display board, said inner tray defining an upwardly-facing article support surface thereon, and a slide structure cooperating between said inner tray and said base for permitting said inner tray to be horizontally slidably displaced between an inner storage position wherein the inner tray is disposed inwardly of the respective display board and an outer access position wherein the inner tray is disposed adjacent and extends longitudinally along and projects sidewardly outwardly from the respective display board adjacent the lower edge thereof.

15. A display unit according to claim 14, wherein said article storage structure is accessible from each end of said display unit.

16. A display unit according to claim 15, wherein said base includes upper and lower support members disposed in vertically spaced relation and defining an interior storage compartment therebetween, said storage compartment being horizontally accessible from opposite sides of said base, said lower support defining an upward-facing support surface and said display boards being disposed with the lower horizontally extending edges thereof positioned adjacent and supported on said upper support, and said trays being slidably supported on said upper support for deposition on opposite sides of said base unit adjacent the lower edges of said display boards.

17. A display unit according to claim 16, wherein each said display board includes a thin magnetically-attractable metal sheet positioned directly under and extending coextensively of the outer surface layer so as to permit magnetic support devices to be attached to the front face of the display board.

18. An upright mobile display unit, comprising:

a wheeled base;

first and second enlarged and platelike display boards mounted on and projecting upwardly from said base in generally back-to-back relation so that said first and second display boards define thereon enlarged and substantially flat outer front faces which face sidewardly in opposite directions, said display boards being mounted so that lower and generally horizontally extending edges thereof are positioned in sidewardly spaced relation relative to said base, said first and second display boards projecting vertically upwardly from said lower edges and each being angled sidewardly toward the other display board so that generally horizontally extending upper edges of said first and second display boards are positioned sidewardly closely adjacent one another, and bracket structure fixedly joined between said first and second display boards in the vicinity of said upper edges, said first and second display boards defining an interior storage region therebetween which extends longitudinally of said display unit and is accessible from at least one end thereof;

storage structure positioned within said interior region adjacent at least said one end thereof and cooperating with back surfaces of said first and second display boards for permitting supportive storage of articles within said storage region;

each said display board including an outer sheetlike surface layer which is of a synthetic resin material so that said outer front face has a smooth and light colored surface capable of writing thereon with erasable ink marker pens;

first and second longitudinally elongate trays positioned adjacent the lower edges of the respective first and second display boards and projecting longitudinally therealong, said first and second trays projecting outwardly relative to the respective display board and defining an upwardly-facing support surface for supporting marker board utensils thereon;

said base including upper and lower support members disposed in vertically spaced relation and defining an interior storage compartment therebetween, said storage compartment being horizontally accessible from opposite sides of said base, and said display boards being disposed with the lower horizontally extending edges thereof positioned adjacent and supported on said upper support, and said first and second trays being supported on said upper support on opposite sides of said base unit adjacent the lower edges of said display boards; and a hanger-accommodating support rod stationarily mounted adjacent a longitudinally extending upper edge of each said display board, said support rod being generally horizontally elongated in the lengthwise direction of the display board and spaced sidewardly outwardly away from the front face of the respective display board in the vicinity of the upper edge thereof.

19. A display unit according to claim 18, wherein said bracket means includes a bracket mounted to said upper edges of said display boards to join said display boards together, said bracket including arm parts which project outwardly away from said front faces of said display boards and support said hanger rods in outwardly spaced relation with said front faces.

20. A display unit according to claim 19, wherein said bracket means includes a plurality of said brackets wherein said brackets are spaced apart along said upper edges so as to support spaced apart sections of said hanger rod.

21. A display unit according to claim 19, which includes at least one hanger unit suspended from said bracket means, said hanger unit including a hook part which hooks onto said hanger rod and an abutment part suspended downwardly from said hook part, said abutment part abutting against a corresponding one of said front faces of said display boards when said hanger unit is suspended from said hanger rod.

22. A display unit according to claim 21, wherein a plurality of said hanger units are provided in spaced apart relation, said hanger units being joined together by an upward-facing support surface extending horizontally therebetween.

23. A display unit according to claim 18, wherein at least one of said first and second trays has an inner tray fixedly joined thereto and projecting inwardly for storage behind the respective display board, said inner tray defining an upwardly-facing article support surface thereon, and a slide structure cooperating between said inner tray and said base for permitting said inner tray to be horizontally slidably displaced between an inner storage position wherein the inner tray is disposed inwardly of the respective display board and an outer access position wherein the inner tray is disposed adjacent and extends longitudinally along and projects sidewardly outwardly from the respective display board adjacent the lower edge thereof.

* * * * *